US012704117B2

(12) United States Patent
MacHarg

(10) Patent No.: US 12,704,117 B2
(45) Date of Patent: Aug. 11, 2026

(54) SLIPPER COMPONENT WITH CERAMIC SURFACE

(71) Applicant: Ocean Pacific Technologies, Ventura, CA (US)

(72) Inventor: John P. MacHarg, Ventura, CA (US)

(73) Assignee: Ocean Pacific Technologies

( * ) Notice: Subject to any disclaimer, the term of this patent is extended or adjusted under 35 U.S.C. 154(b) by 0 days.

(21) Appl. No.: 19/038,600

(22) Filed: Jan. 27, 2025

(65) Prior Publication Data

US 2026/0218689 A1 Jul. 30, 2026

(51) Int. Cl.
*F04B 1/146* (2020.01)

(52) U.S. Cl.
CPC ..... *F04B 1/146* (2013.01)

(58) Field of Classification Search
CPC ..... F04B 1/126
See application file for complete search history.

(56) References Cited

U.S. PATENT DOCUMENTS 5,520,088 A * 5/1996 Dixen ..... F04B 1/126 91/499
2008/0223207 A1* 9/2008 Olsen ..... F04B 1/124 92/71
2013/0118346 A1* 5/2013 MacHarg ..... F04B 1/2078 92/57
2015/0285076 A1* 10/2015 Bergmann ..... F03C 1/0671 92/12.2
2016/0281505 A1* 9/2016 MacHarg ..... F04B 1/2035
2023/0279947 A1* 9/2023 Andersen ..... F16L 27/04 92/178
2025/0207664 A1* 6/2025 Svendsen ..... F04B 1/126

FOREIGN PATENT DOCUMENTS

WO WO-2021126828 A1 * 6/2021 ..... F04B 1/2021

* cited by examiner

*Primary Examiner* — Thomas Fink
(74) *Attorney, Agent, or Firm* — Fitch, Even, Tabin & Flannery LLP

(57) ABSTRACT

Slippers, which can be suitable for use in rotary axial piston pumps, can include a swash plate interface surface of an annular ceramic ring attached to the slipper.

20 Claims, 5 Drawing Sheets

SLIPPER COMPONENT WITH CERAMIC SURFACE

FIELD

A slipper, such as those suitable for use in rotary axial piston pumps, is described herein and, in particular, a slipper having a ceramic bearing/interface feature.

BACKGROUND

Rotary axial piston pumps (RAPPs) are known in the art and can be constructed for a number of different end-use applications. One category of RAPPs are configured for use in applications, e.g., oil hydraulic transport, that permit the internal components that are subjected to friction to be oil lubricated, thereby helping to reduce the unwanted effects of friction to provide a desired service life. Another category of RAPPs are configured for use in applications, e.g., water hydraulic transport, that do not permit the internal components subjection to friction to be oil lubricated. In such applications, the RAPPs are configured to use plain water without additives or aides as the only friction lubricating medium.

Conventional RAPPs configured for water hydraulic transport service use internal parts, subjected to friction during use, that are specifically configured to include a polymeric low-friction surface feature. Such a conventional RAPPs comprise metallic valve and port plates that include a polymeric interface surfaces.

While such RAPPs are configured to address frictional wear effects between adjacent metallic parts during water hydraulic transport use, the use of such RAPPs configured in the manner described require that the water entering the pump be filtered to very high levels to remove particulate matter. If unfiltered to a sufficient degree, the particulate matter in the water can otherwise wear and/or damage polymeric surface feature resulting in metal-to-metal contact, thereby reducing the effective service life of the RAPP. The need to filter the water transported by the RAPPs to protect against unwanted damage and/or reduced service life involves using filtration equipment that adds labor and material costs to the overall cost of operating such RAPPs. Furthermore, wear can adversely impact the precision clearances relied upon for sealing, and can thereby result in loss in pump efficiency and flow.

Thus, while RAPPs configured for water transport service are constructed to provide some degree of low friction operation under certain operating conditions, e.g., ultra-clean conditions, it is desired that an RAPP be constructed in a manner that permits a more robust operating parameters in water transport services in terms of both improved service life and in terms of reduced water pretreatment requirements. Specifically, it is desired that an RAPP be constructed in a manner comprising internal parts specially developed and engineered to provide an improved degree of friction reduction performance, thereby extending service life when compared to conventional water transport RAPPs.

It is further desired that such RAPPs comprising such construction provide the improved degree of friction reduction performance in a manner that avoids the need to filter the incoming water to ultra-fine standards, thereby reducing the overall equipment and labor costs associated with RAPP operation. Finally, it is desired that such RAPP be constructed in a manner avoiding the use of exotic materials and/or nonconventional manufacturing techniques, thereby minimizing any such impact on material and manufacturing costs.

One solution to the aforementioned problem is to use a ceramic slipper. Ceramic slippers can advantageously reduce wear and erosion while being manufactured with the precise tolerances, and can be particularly suitable for use in water-lubricated pumps. However, ceramic can be expensive and challenging to machine as compared to metal components, and can fracture. One option is to use ceramic veneers instead of making the entire slipper of ceramic. However, maintaining a bond between the ceramic material of the veneer and the material of the slipper can be challenging.

SUMMARY

A rotary axial piston pump is described herein that including: a housing; a swash plate, the swash plate having an inclined surface; a rotor assembly positioned adjacent the swash plate, the rotor assembly including a rotor-drum having at least one cylinder bore disposed therein, and having piston(s) disposed within the respective cylinder bore(s), the pistons having a ball-shaped end extending from the cylinder bore(s); at least one slipper interposed between the swash plate and the rotor-drum, the slipper(s) including socket joints for accommodating the piston ball-shaped end(s) therein, the slipper(s) having a swash plate interface surface in contact with the swash plate inclined surface; a port plate positioned adjacent an end block disposed in the housing open end; and a valve plate interposed between the port plate and the rotor-drum; wherein the swash plate interface surface includes an annular ceramic ring attached to the slipper, the annular ceramic ring having an axially facing upper surface, a radially outward surface and a radially inward surface, the axially facing upper surface of the annular ceramic ring facing a lower surface of the slipper, the radially inward surface of the annular ceramic ring being positioned about an inner annular wall of the slipper, and a seal positioned between the radially inward surface of the annular ceramic ring and the inner annular wall of the slipper to restrict pressurized fluid from flowing between the lower surface of the slipper and the axially facing upper surface of the annular ceramic ring.

In some aspects, the techniques described herein relate to a rotary axial piston pump, wherein an outer annular wall of the slipper surrounds the radially outward surface of the annular ceramic ring.

In some aspects, the techniques described herein relate to a rotary axial piston pump, wherein the slipper includes an annular recess for partially receiving the annular ceramic ring, the annular recess having the lower surface of the slipper, the inner annular wall and the outer annular wall.

In some aspects, the techniques described herein relate to a rotary axial piston pump, wherein the seal includes an O-ring.

In some aspects, the techniques described herein relate to a rotary axial piston pump, wherein the seal includes a gasket.

In some aspects, the techniques described herein relate to a rotary axial piston pump, wherein the seal is elastomeric.

In some aspects, the techniques described herein relate to a rotary axial piston pump, wherein the seal surrounds the radially outward surface of the annular ceramic ring In some aspects, the techniques described herein relate to a rotary axial piston pump, wherein the seal is received in an annular groove or step in the inner annular wall of the slipper.

In some aspects, the techniques described herein relate to a rotary axial piston pump, wherein the annular ceramic ring is attached to the slipper using an adhesive.

In some aspects, the techniques described herein relate to a rotary axial piston pump, wherein a pin extends between the slipper and the annular ceramic ring to restrict rotation of the ring relative to the slipper.

In some aspects, the techniques described herein relate to a rotary axial piston pump, wherein the annular ceramic ring is held in compression.

In some aspects, the techniques described herein relate to a rotary axial piston pump, wherein the annular ring is held in compression by the outer annular wall of the slipper.

In some aspects, the techniques described herein relate to a slipper suitable for use in a rotary axial piston pump interposed between a swash plate and a rotor-drum, the slipper including a socket joint for accommodating a piston ball-shaped end therein, the slipper having a swash plate interface surface formed from an annular ceramic ring, the annular ceramic ring having an axially facing upper surface, a radially outward surface and a radially inward surface, the axially facing upper surface of the annular ceramic ring facing a lower surface of the slipper, the radially inward surface of the annular ceramic ring being positioned about an inner annular wall of the slipper, and a seal positioned between the radially inward surface of the annular ceramic ring and the inner annular wall of the slipper to restrict pressurized fluid from flowing between the lower surface of the slipper and the axially facing upper surface of the annular ceramic ring.

In some aspects, the techniques described herein relate to a slipper, wherein an outer annular wall surrounds the radially outward surface of the annular ceramic ring.

In some aspects, the techniques described herein relate to a slipper, wherein the slipper includes an annular recess for partially receiving the annular ceramic ring, the annular recess having the lower surface of the slipper, the inner annular wall and the outer annular wall.

In some aspects, the techniques described herein relate to a slipper, wherein the seal includes an O-ring.

In some aspects, the techniques described herein relate to a slipper, wherein the seal includes a gasket.

In some aspects, the techniques described herein relate to a slipper, wherein the seal is elastomeric.

In some aspects, the techniques described herein relate to a slipper, wherein the seal surrounds the radially outward surface of the annular ceramic ring In some aspects, the techniques described herein relate to a slipper, wherein the seal is received in an annular groove or step in the inner annular wall of the slipper.

In some aspects, the techniques described herein relate to a slipper, wherein the annular ceramic ring is attached to the slipper using an adhesive.

In some aspects, the techniques described herein relate to a slipper, wherein a pin extends between the slipper and the annular ceramic ring to restrict rotation of the ring relative to the slipper.

In some aspects, the techniques described herein relate to a method, wherein the slipper includes a fluid passage, radially inward with respect to the inward inner annular wall of the slipper, the method including: supplying pressurized fluid to the swash plate interface surface and the swash plate inclined surface via the fluid passage of the slipper; and restricting the pressurized fluid from flowing past the seal and between the lower surface of the slipper and the axially facing upper surface of the annular ceramic ring.

DETAILED DESCRIPTION

A slipper suitable for use in a rotary axial piston pump is described herein and depicted in FIGS. 1-9. In use, the slipper can be interposed between a swash plate and a rotor-drum, the slipper comprising a socket joint for accommodating a piston ball-shaped end therein. The slipper has a swash plate interface surface formed from a ceramic veneer, which can be an annular ceramic ring. The annular ceramic ring has an axially facing upper surface, a radially outward surface and a radially inward surface. The axially facing upper surface of the annular ceramic ring faces or abuts a lower surface of the slipper. The radially inward surface of the annular ceramic ring is positioned about an inner annular wall of the slipper.

Advantageously, a seal, such as an O-ring or other elastomeric element, is positioned between the radially inward surface of the annular ceramic ring and the inner annular wall of the slipper to restrict, in use, pressurized fluid from flowing between the lower surface of the slipper and the axially facing upper surface of the annular ceramic ring. An increase in pressure between the axially facing upper surface of the annular ceramic ring and the lower surface of the slipper can cause the annular ceramic ring to be forced away from the slipper. If attached via adhesive, for example, an increase in pressure can cause the annular ceramic ring to detach from the slipper. The inner location between the radially inward surface of the annular ceramic ring and the inner annular wall of the slipper can be subject to high pressures, such as 1000 psi. In contrast, the outer location adjacent the radially outward surface of the annular ceramic ring can be subject to relatively lower pressures as compared to the inner location, such as 30 psi. Thus, positioning the seal between the radially inward surface of the annular ceramic ring and the inner annular wall of the slipper can restrict, in use, high pressure fluid from flowing between the axially facing upper surface of the annular ceramic ring and the lower surface of the slipper and potentially dislodging the annular ceramic ring.

Figure 1:
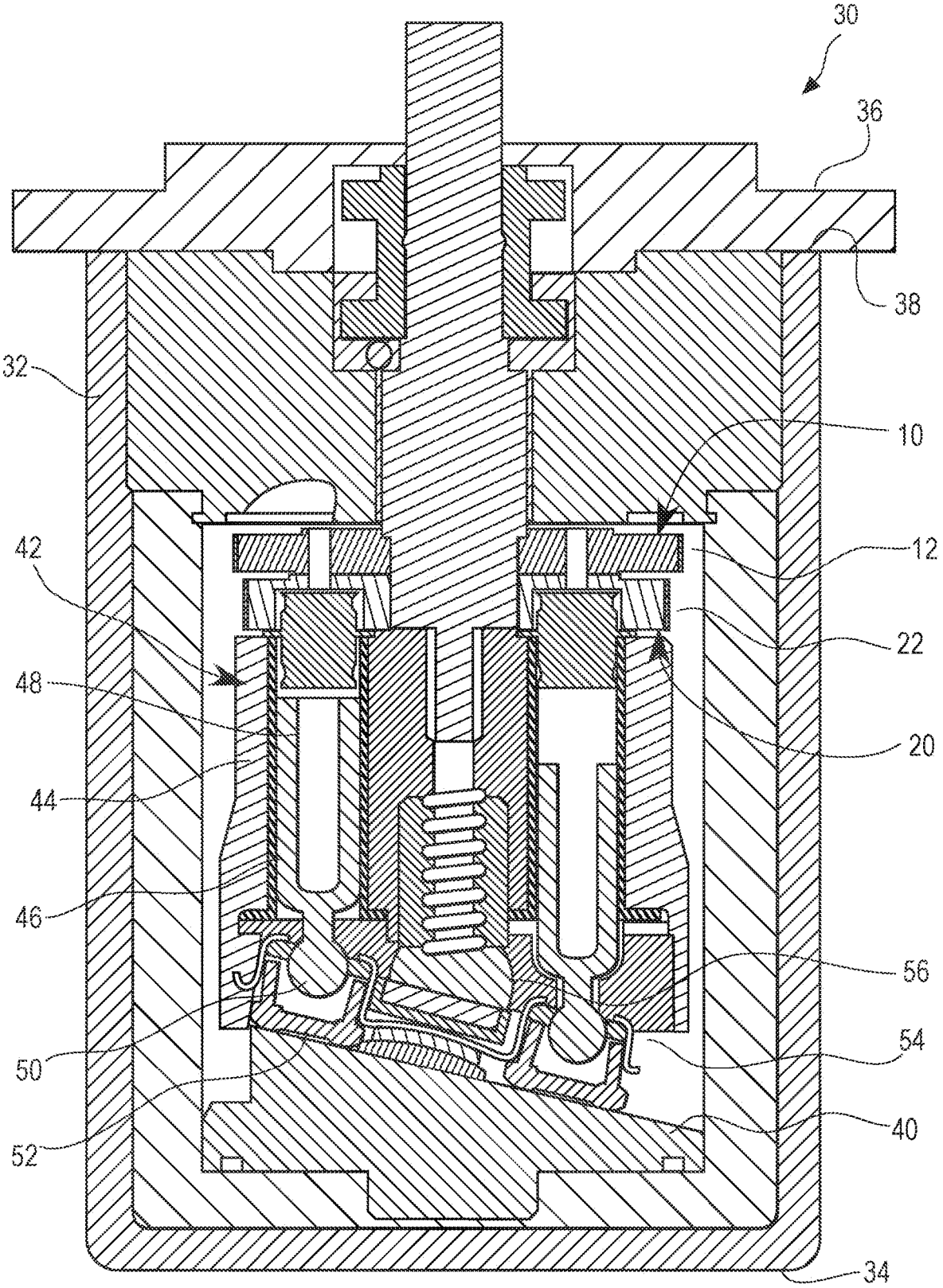
FIG. 1 is a cross-sectional view of a RAPP having one or more ceramic veneers on each of a valve plate, port plate and piston slippers.
Figure 2:
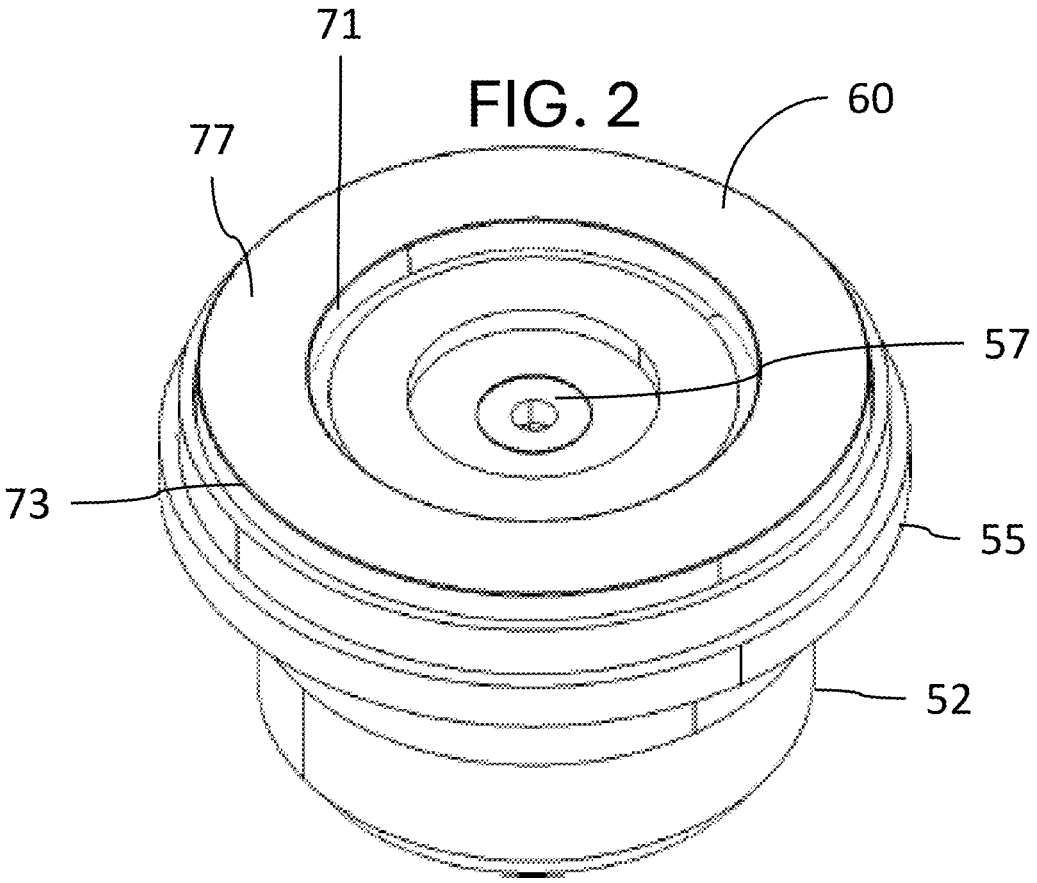
FIG. 2 is a bottom perspective view of a piston slipper suitable for use in the RAPP of FIG. 1, showing an annular recess having an annular ceramic ring in the inserted therein.

Turning now to a description of a RAPP 30, and with reference to FIG. 1, the RAPP 30 can incorporate a set of port and valve plates 10 and 20. The RAPP 30 comprises a stator assembly including a housing 32 having a generally closed first end 34 at one axial end, and having an end block 36 attached to an otherwise opposed open end 38 of the housing 32. The port plate 10 is disposed within the housing 32 and is positioned adjacent an inside surface of the end block 54. The port plate 10 does not rotate relative to the housing 32. A swash plate 40 is disposed within the housing 32 and positioned adjacent an inside surface of the closed first end 34 of the housing 32. The swash plate 40 is a stationary member that does not rotate relative to the housing 3 and provides a smooth flat inclined surface that extends towards the valve plate 20. A rotor assembly 42 is disposed within the housing and comprises a cylindrical rotor-drum 44 that is interposed between the valve plate 20 and the swash plate 40. The rotor-drum 44 is configured to rotate within the housing 32 and comprises an array of axial cylinder bores 46, each fitted with an axial piston 48. Each axial piston 48 comprises a ball-shaped end 50 in swivel engagement with a slider shoe or slipper 52 held against the inclined surface of swash plate 40. The slipper 52 preferably, though not necessarily, includes a ceramic ring, as will be described in more detail below.

The slippers 52 are supported in a uniform array and held against swash plate 40 by a shoe pressure plate 54, which bears against the central region of rotor-drum 44 via a hemispherical swivel member 56. At the other end of rotor-drum, the attached valve plate 20 interfaces with the port plate 10 at a sliding interface to serve as a sliding valve control system. The valve plate 20 rotates with the rotor-drum 44 within the housing 32.

The valve plate 20 is configured having a number of openings therethrough that align with respective openings in the cylinder bores 46. The port plate 10 also comprises openings that are in alignment with inlet and outlet ports extending through the end block 36. As the rotor-drum 44 rotates within the housing 32, the port plate openings align with the valve openings to facilitate fluid inlet and outlet in a manner corresponding to the piston inlet and outlet strokes to provide the desired fluid transport by the RAPP 30.

Generally speaking, the internal components or parts of such RAPPs that are subjected to frictional forces during pump operation include the interface surfaces between the valve plate 20 and the port plate 10, the interface surfaces between the swash plate 40 and the piston slippers 52, and the interface between the piston ball-shaped end 50 and the slipper 52. Ceramic veneers can be provided on any of those interface surfaces. When the RAPP is configured for use in oil hydraulic transport service, such interface surfaces are lubricated by the oil being transported, which operates to reduce the frictional forces existing at the metallic interfacing surfaces. However, when used for water transport, the water can provide lubrication.

To reduce the amount of ceramic used, ceramic veneers can be used instead of having the entire body made of ceramic. For example, the valve and port plates can each include one or more ceramic veneers. The valve plate can have multiple ceramic veneers in places where there will be sliding contact with the port plate. For example, the valve plate 20 includes multiple ceramic veneers. Similarly, the port plate 10 includes a ceramic veneer. Each of the veneers can be received in a recess having a pair of sidewalls with negative draft angles. The veneers can be adhesively secured in their respective recesses. Excess adhesive can flow into the gaps between the negative draft sidewalls of the recess and the sidewalls of the veneers. This both provides a place for excess adhesive to flow as well as, once hardened, locking the veneer in the recess.

The slippers 52 can each include a socket 51 for receiving the piston ball-shaped end 50 of the piston 48. The socket 51 can include a friction-reducing liner 53. The slippers 52 can each also include an outer annular friction-reducing outer layer 55. The bottom portion of the socket 51 includes an opening 57 to an underside 59 of the slipper 52. In use, pressurized fluid flows through the opening 57 to the underside 59 of the slipper 52.

The underside 59 of each of the slippers 52 can be an annular recess 58, as shown in FIGS. 3 and 7-9. An annular ceramic ring 60 is secured in the recess 58, as shown in FIGS. 2, 5 and 6-9. The ceramic ring 60 includes a radially inward surface 71, a radially outward surface 73, an upper surface 75 and a lower surface 77. The upper surface 75 of the ceramic ring 60 is positioned adjacent the underside 59 of the recess 68.

The annular recess 58 includes a pair of opposing sidewalls 64 and 66, with an outer, radially-inward facing sidewall 64 and an inner, radially outward facing sidewall 66, as well as the underside 59 itself as a bottom wall of the recess 58. Optionally, a step 65 can be provided at the intersection of the inner sidewall 66 and the underside 59. The step 65 can help with spacing or centering of the annual ceramic ring 60. The step 65 can also help with seating the seal.

The ceramic ring 60 can be secured using adhesive and/or holding the ceramic ring 60 in compression. For example, adhesive can be used to adhere the upper surface 75 of the ceramic ring 60 to the underside 59 of the slipper 52 within the annular recess 58. Also by way of example, the slipper 52—such as when made of metal—can be heated so that the distance between the pair of opposing sidewalls 64 and 66 increases temporarily for insertion of the ceramic ring 60. Upon cooling, the distance between the pair of sidewalls 64 and 66 decreases, thereby holding the ceramic ring 60 in compression.

Figure 5:
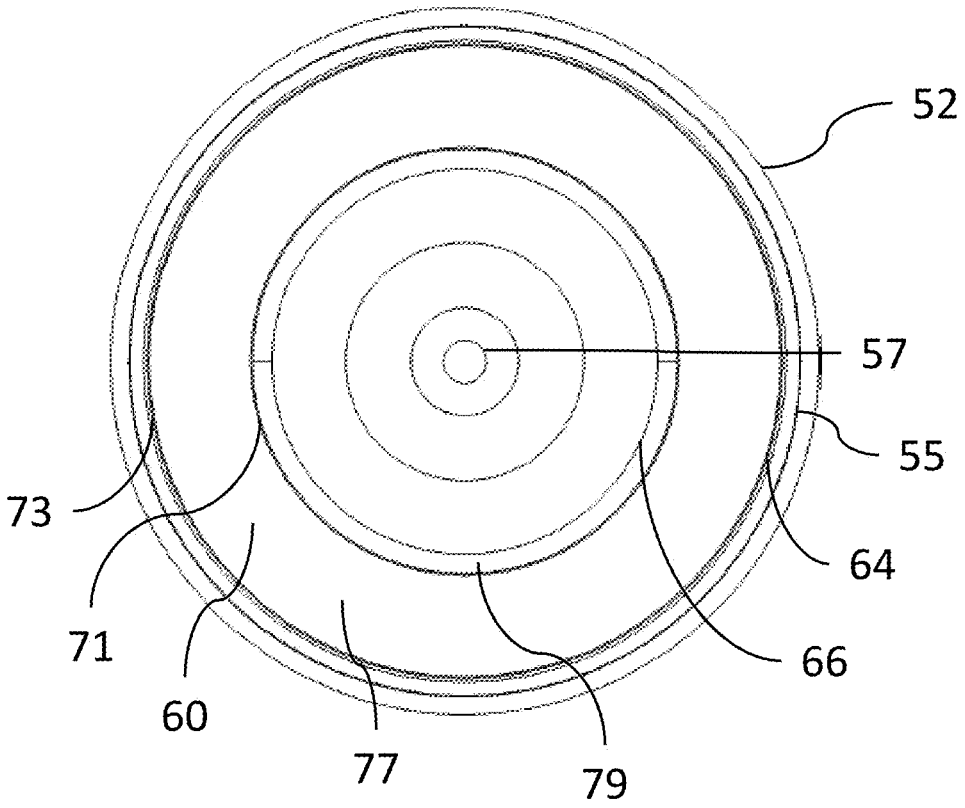
FIG. 5 is a bottom plan view of the piston slipper of FIG. 2.
Figure 7:
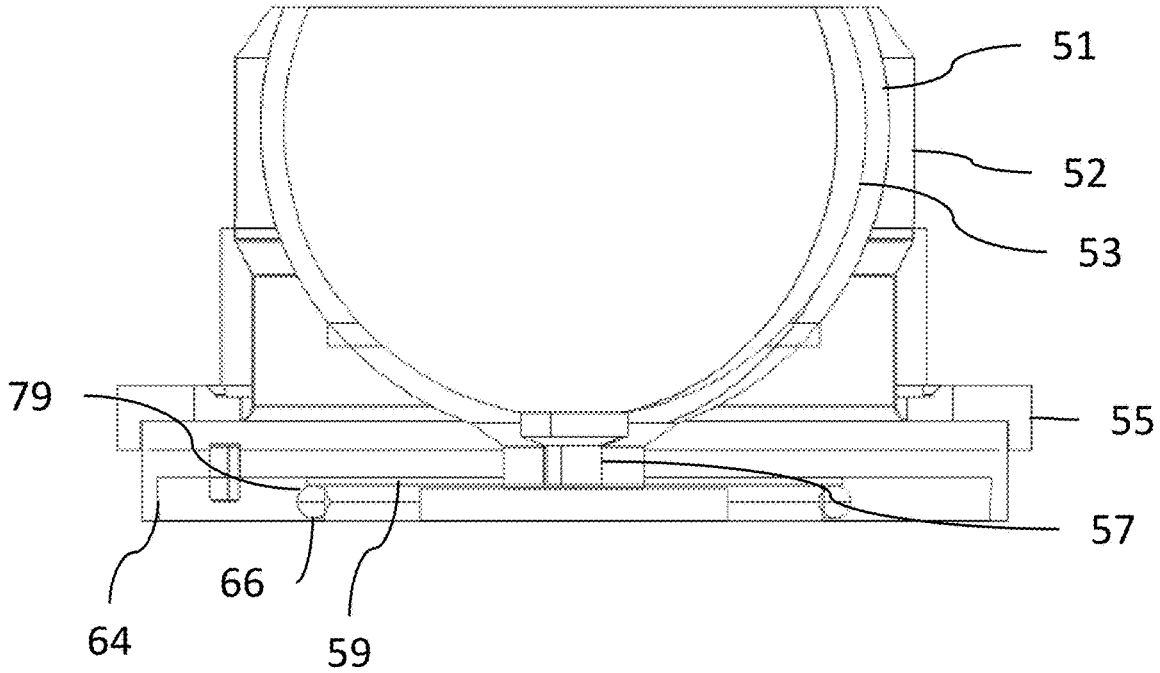
FIG. 7 is a cross-section view of the piston slipper of FIG. 2, similar to the view of FIG. 6 but without the ceramic ring.
Figure 8:
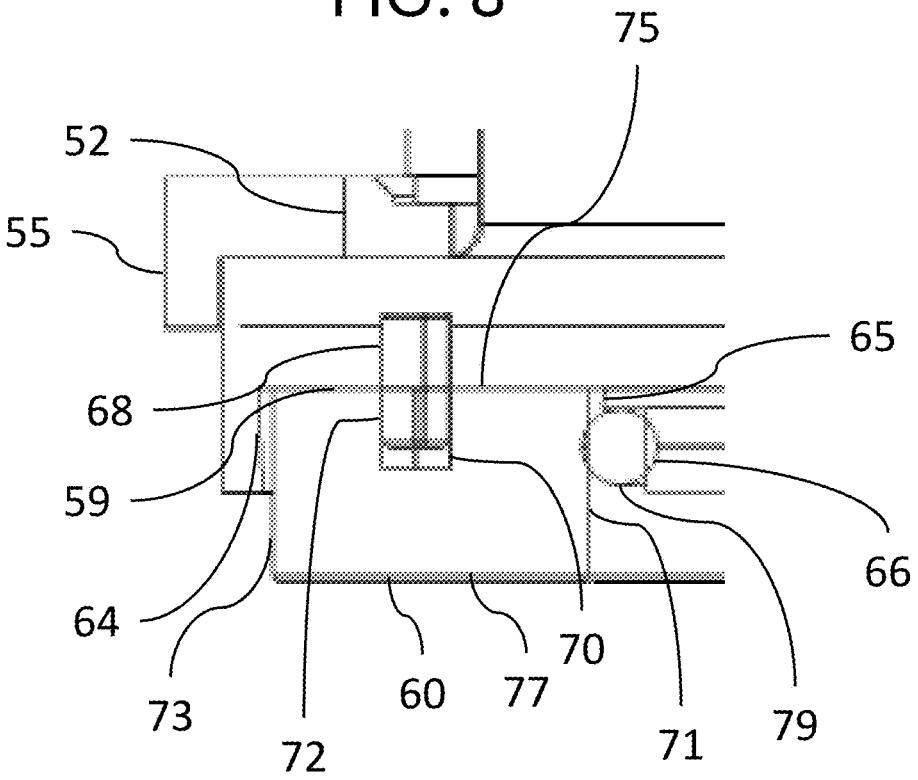
FIG. 8 is a close-up view of a portion of the piston slipper of FIG. 5 showing the recess with the ring received in the recess.
Figure 9:
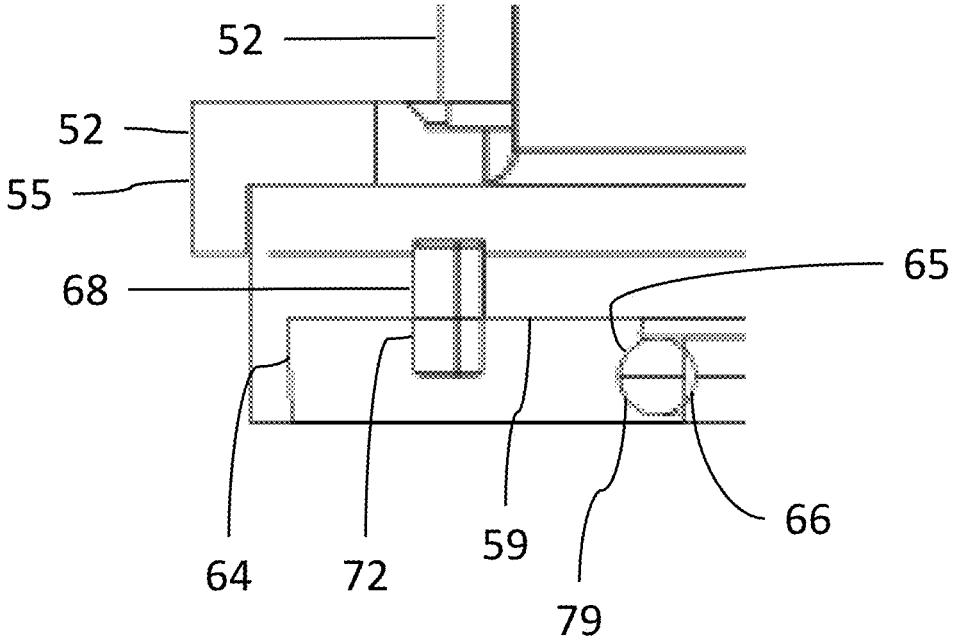
FIG. 9 is a view of the piston slipper similar to that of FIG. 7, but without the ring in the recess.

The sidewalls 64 and 66 of the recess 68 each may optionally have a negative draft angle, as shown in FIGS. 8 and 9. The negative draft angle can be of any suitable angle, e.g., 2 degrees or more, by way of non-limiting example, about 6 degrees. When the ceramic ring 60 is received in the recess 68, as shown in FIGS. 5 and 7, a gap 74 is created between each sidewall 64 and 66 and the side of the ring 60. A layer of adhesive attaches the ring 60 to the bottom wall 59 of the recess 68. Excess adhesive can flow into the expansion zone or gap and create a bulge. Having a place for excess adhesive to flow can advantageously help with keeping the ring 60 coplanar with the bottom wall 59 of the recess 58. In addition, once hardened, the adhesive bulge can help to lock the ring 60 in place. More specifically, the attached bulge of adhesive will resist vertical movement out of the recess 58 due to the negative draft angle of the sidewalls 64 and 66 of the recess 58. Examples of suitable adhesives include epoxies, acrylics and urethanes, although other adhesives can also be suitable.

Figure 6:
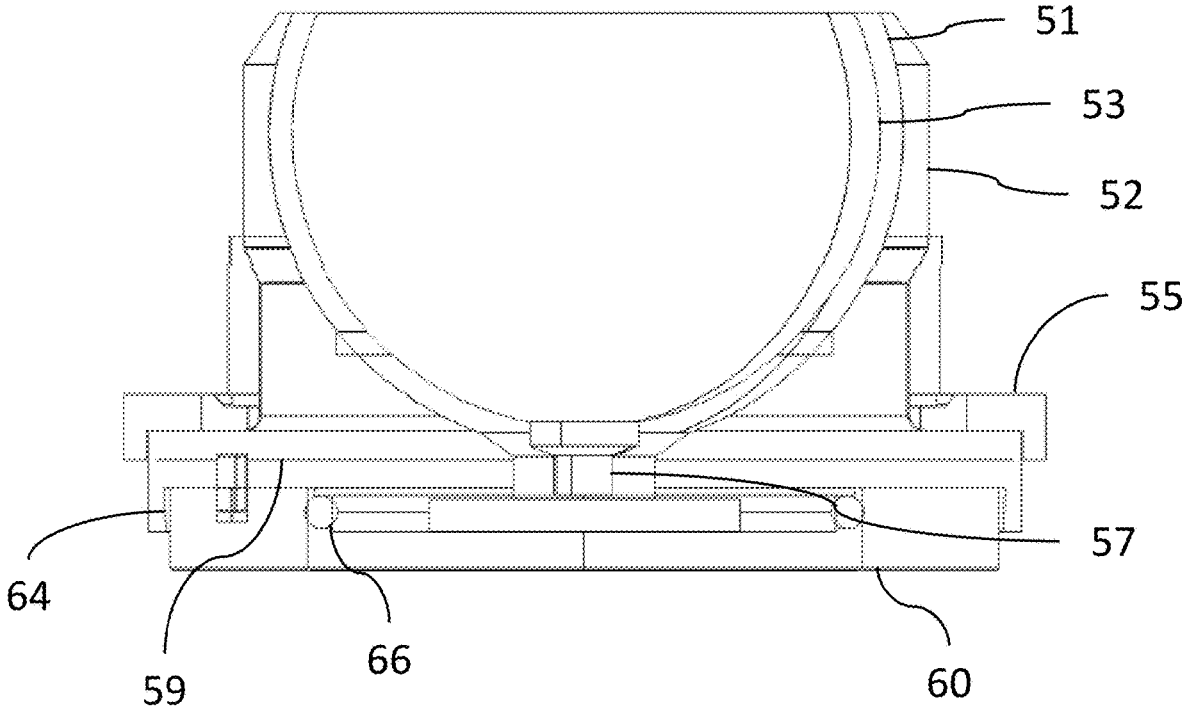
FIG. 6 is a cross-sectional view of the piston slipper of FIG. 2 taken along line 6-6 of FIG. 5.

A seal, such as an elastomeric O-ring 79, is positioned between the radially inward surface 71 of the annular ceramic ring 60 and the inner sidewall 66 of the slipper 52, as shown in FIGS. 6 and 8, to restrict pressurized fluid from flowing between the underside 59 of the recess 58 of the slipper 52 and the axially facing upper surface 75 of the annular ceramic ring 60. High pressure fluid entering between the underside 59 of the recess 58 of the slipper 52 and the axially facing upper surface 75 of the annular ceramic ring 60 can disadvantageously lead to the annular ceramic ring 60 being forced away from the underside 59 of the recess 58 of the slipper 52. A gap between the radially inward surface 71 of the annular ceramic ring 60 and the inner sidewall 66 of the recess 58 of the slipper 62 can provide space for the O-ring 79, as shown in FIG. 8. The optional step 65 can help with seating the O-ring 79. The seal can be formed of other elastomeric structures, such as an elastomeric gasket. The seal, such as the O-ring 79, can surround the radially outward surface 73 of the annular ceramic ring 60.

The annular ceramic ring 60 of the slipper 52 can also be configured to resist rotation in the annular recess 58. This is accomplished using a pin 72, which can be metal, that has one end received in an annular bore 68 in the recess and another end received in an annular bore 70 in the ring 60, as shown in FIGS. 8 and 9. The pin 72 can be adhesively secured in both bores 68 and 70.

Figure 3:
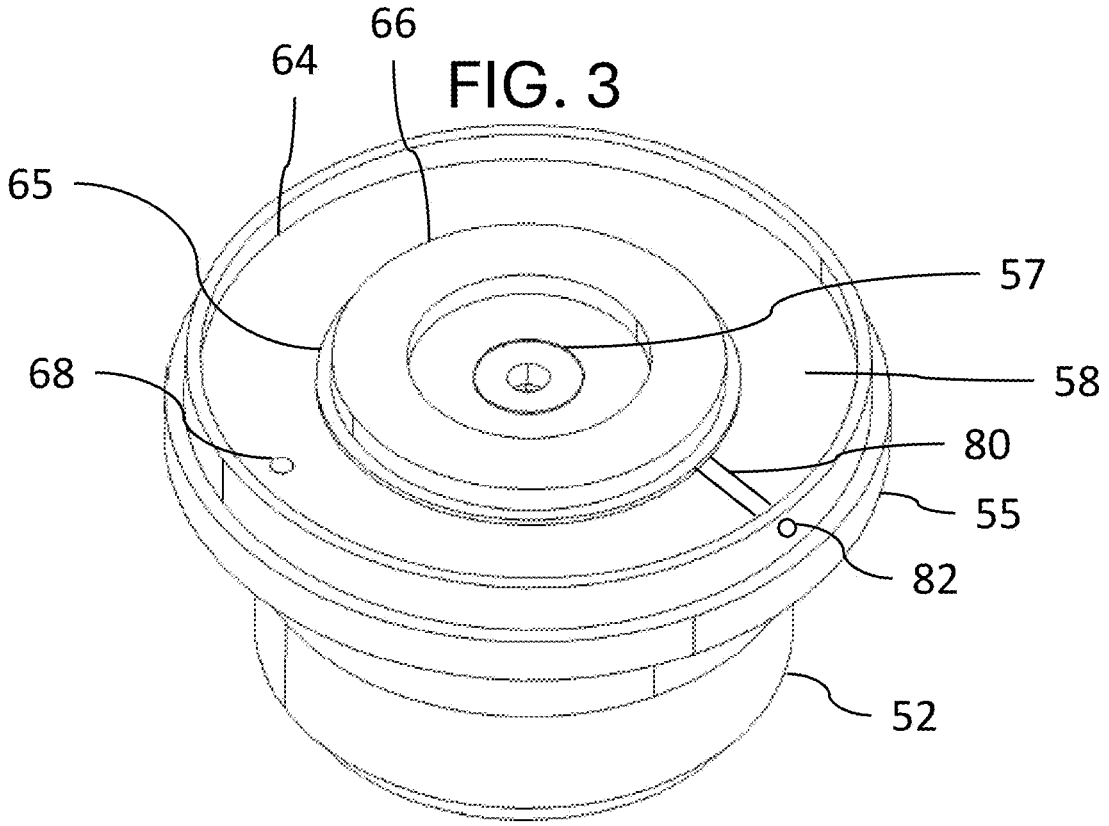
FIG. 3 is a bottom perspective view, similar to that of FIG. 2, of the piston slipper of FIG. 1, showing the annular recess without the annular ceramic ring inserted therein.
Figure 4:
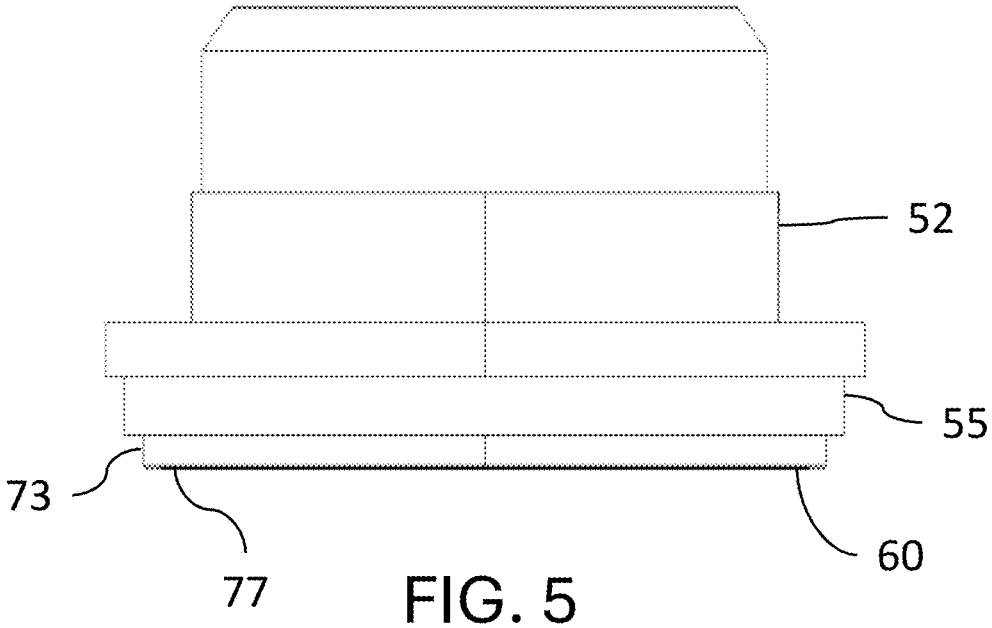
FIG. 4 is a side elevation view of the piston slipper of FIG. 2.

An optional weep groove or channel 80 and weep hole 82 can be formed in the recess 58 of the slipper 52 for allowing air or fluid that may have entered at least partially between the underside 59 of the recess 58 of the slipper 52 and the axially facing upper surface 75 of the annular ceramic ring 60. This can be useful during either or both of assembly and operation. More specifically, the weep channel 80 can be formed in the underside 59 of the recess 58 of the slipper 52, as shown in FIG. 3. That weep channel 80 is in communication with a weep hole 82 that passes through the outer sidewall 64 of the recess 58, also as shown in FIG. 3.

Examples of suitable ceramic materials include metal oxides and metal carbides. Examples of preferred ceramic materials include but are not limited to aluminum oxide, silicon carbide, tungsten carbide and combinations thereof. In an example embodiment, the annular ceramic ring 60 can have a thickness of about 0.1 to 0.25 inches, 0.1 to 0.2 inches, or about 0.173 inches. The ring 60 can have an inner diameter of about 0.5 to 0.7 inches, or about 0.595 inches. The ring 60 can have an outer diameter of between 1 and 2.5 inches, 1.5 to 2 inches, or about 1.763 inches.

The invention claimed is:

1. A rotary axial piston pump comprising:

a housing;

a swash plate, the swash plate having an inclined surface;

a rotor assembly positioned adjacent the swash plate, the rotor assembly comprising a rotor-drum having at least one cylinder bore disposed therein, and having piston (s) disposed within the respective cylinder bore(s), the pistons having a ball-shaped end extending from the cylinder bore(s);

at least one slipper interposed between the swash plate and the rotor-drum, the slipper(s) comprising socket joints for accommodating the piston ball-shaped end(s) therein, the slipper(s) having a swash plate interface surface in contact with the swash plate inclined surface;

a port plate positioned adjacent an end block disposed in the housing open end; and a valve plate interposed between the port plate and the rotor-drum;

wherein the swash plate interface surface comprises an annular ceramic ring attached to the slipper, the annular ceramic ring having an axially facing upper surface, a radially outward surface and a radially inward surface, the axially facing upper surface of the annular ceramic ring facing a lower surface of the slipper, the radially inward surface of the annular ceramic ring being positioned about an inner annular wall of the slipper, and a seal positioned between the radially inward surface of the annular ceramic ring and the inner annular wall of the slipper to restrict pressurized fluid from flowing between the lower surface of the slipper and the axially facing upper surface of the annular ceramic ring, the lower surface of the slipper having a weep groove or channel.

2. The rotary axial piston pump of claim 1, wherein an outer annular wall of the slipper surrounds the radially outward surface of the annular ceramic ring, the outer annular wall having a weep hole in communication with the weep groove or channel.

3. The rotary axial piston pump of claim 2, wherein the slipper includes an annular recess for partially receiving the annular ceramic ring, the annular recess having the lower surface of the slipper, the inner annular wall and the outer annular wall.

4. The rotary axial piston pump of claim 1, wherein the seal comprises an O-ring.

5. The rotary axial piston pump of claim 1, wherein the seal comprises a gasket.

6. The rotary axial piston pump of claim 1, wherein the seal is elastomeric.

7. The rotary axial piston pump of claim 1, wherein the seal surrounds the radially outward surface of the annular ceramic ring.

8. The rotary axial piston pump of claim 1, wherein the annular ceramic ring is attached to the slipper using an adhesive.

9. The rotary axial piston pump of claim 1, further comprising means for restricting rotation between the slipper and the annular ceramic ring.

10. The rotary axial piston pump of claim 1, wherein the annular ceramic ring is held in compression.

11. The rotary axial piston pump of claim 1, wherein the annular ring is held in compression by the outer annular wall of the slipper.

12. A slipper suitable for use in a rotary axial piston pump interposed between a swash plate and a rotor-drum, the slipper comprising a socket joint for accommodating a piston ball-shaped end therein, the slipper having a swash plate interface surface formed from an annular ceramic ring, the annular ceramic ring having an axially facing upper surface, a radially outward surface and a radially inward surface, the axially facing upper surface of the annular ceramic ring facing a lower surface of the slipper, the radially inward surface of the annular ceramic ring being positioned about an inner annular wall of the slipper, and a seal positioned between the radially inward surface of the annular ceramic ring and the inner annular wall of the slipper to restrict pressurized fluid from flowing between the lower surface of the slipper and the axially facing upper surface of the annular ceramic ring, the slipper having a step provided at an intersection of the lower surface of the slipper and the inner annular wall of the slipper to provide a gap between the radially inward surface of the annular ceramic ring and the inner annular wall of the slipper.

13. The slipper of claim 12, wherein an outer annular wall surrounds the radially outward surface of the annular ceramic ring.

14. The slipper of claim 13, wherein the slipper includes an annular recess for partially receiving the annular ceramic ring, the annular recess having the lower surface of the slipper, the inner annular wall and the outer annular wall.

15. The slipper of claim 12, wherein the seal comprises an O-ring.

16. The slipper of claim 15, wherein the O-ring surrounds the radially outward surface of the annular ceramic ring.

17. The slipper of claim 16, wherein the annular ceramic ring is attached to the slipper using an adhesive.

18. The slipper of claim 12, wherein a pin extends between the slipper and the annular ceramic ring to restrict rotation of the ring relative to the slipper.

19. The rotary axial piston pump of claim 12, wherein the annular ceramic ring is held in compression.

20. A method of using the rotary axial piston pump of claim 1, wherein the slipper includes a fluid passage, radially inward with respect to the inward inner annular wall of the slipper, the method comprising:

supplying pressurized fluid to the swash plate interface surface and the swash plate inclined surface via the fluid passage of the slipper; and restricting the pressurized fluid from flowing past the seal and between the lower surface of the slipper and the axially facing upper surface of the annular ceramic ring.

* * * * *